US006082575A

United States Patent [19]

Skoskiewicz et al.

[11] Patent Number: 6,082,575

[45] Date of Patent: Jul. 4, 2000

[54] HYBRID BEVERAGE CONTAINER

[75] Inventors: Andrzej Skoskiewicz, Menlo Park; Elisha Tal, San Francisco; Rickson Sun, Palo Alto, all of Calif.; Patrick Gilmore, Memphis, Tenn.; Said Farha, Chappaqua; Eileen Bravmann, South Salem, both of N.Y.; Roby Stancel, Los Altos Hills, Calif.; Scott Stropkay, Carlisle; Axel Unger, Boston, both of Mass.; Gary Shigeru Natsume, San Jose, Calif.; Robert C. Meyer, Wilton; Adriana Colombo, New Fairfield, both of Conn.

[73] Assignee: PepsiCo, Inc., Purchase, N.Y.

[21] Appl. No.: 09/038,689

[22] Filed: Mar. 9, 1998

[51] Int. Cl.[7] ..... B65D 21/00; B65D 47/00; B65D 51/16

[52] U.S. Cl. ..... 220/711; 206/515; 215/307; 220/203.05; 220/366.1; 220/714; 222/548; 222/557

[58] Field of Search ..... 222/548, 557, 222/482, 481.5, 554; 220/503.05, 203.06, 711, 714, 380, 703, 717, 718, 366.1, 254, 253, 360; 206/203, 508, 520, 515; 215/307, 354, 309; 229/404, 906.1

[56] References Cited

U.S. PATENT DOCUMENTS

| | | | |
|---|---|---|---|
| 1,963,602 | 6/1934 | Stewart . | |
| 2,173,030 | 9/1939 | White | 220/360 |
| 2,545,350 | 3/1951 | Fuld | 215/309 X |
| 3,307,602 | 3/1967 | Booster . | |
| 3,397,803 | 8/1968 | Melton | 215/256 X |
| 3,506,167 | 4/1970 | Orr | 215/309 X |
| 3,570,727 | 3/1971 | Croyle | 222/554 |
| 3,635,380 | 1/1972 | Fitzgerald | 229/906.1 X |
| 3,741,424 | 6/1973 | Landen | 215/354 X |
| 4,347,954 | 9/1982 | Schiemann | 215/309 X |
| 4,508,235 | 4/1985 | Steele et al. | 229/906.1 X |
| 4,838,464 | 6/1989 | Briggs | 215/40 X |
| 4,926,915 | 5/1990 | Deussen et al. | 141/290 |
| 4,928,861 | 5/1990 | Schiemann | 222/481.5 |
| 5,125,512 | 6/1992 | O'Leary | 229/404 X |
| 5,176,278 | 1/1993 | Quarberg | 220/711 X |
| 5,419,467 | 5/1995 | Maguire et al. | 222/548 |
| 5,427,269 | 6/1995 | Willbrandt . | |
| 5,433,337 | 7/1995 | Willbrandt | 220/669 |
| 5,460,283 | 10/1995 | MaCartney et al. | 215/354 X |

FOREIGN PATENT DOCUMENTS

| | | | |
|---|---|---|---|
| 210856 | 10/1957 | Australia | 220/4.21 |
| 654417 | 5/1995 | European Pat. Off. . | |
| 332613 | 11/1903 | France | 215/309 |
| 1235528 | 12/1960 | France . | |
| 441453 | 11/1948 | Italy | 215/309 |
| 277946 | 9/1951 | Switzerland | 215/309 |
| 210063 | 12/1966 | Switzerland | 222/548 |
| 2264858 | 9/1993 | United Kingdom . | |

*Primary Examiner*—Allan N. Shoap
*Assistant Examiner*—Joe Merek
*Attorney, Agent, or Firm*—Fitzpatrick, Cella, Harper & Scinto

[57] ABSTRACT

A beverage container is disclosed which includes a stackable cup and a stackable cover which have cooperating thread forms for selectively securing the cover to the cup in a substantially liquid-tight relationship. The cover has a beverage dispensing opening and a cap which is selectively operable to open and close the opening to prevent beverage in the container from being poured out of the opening and to selectively allow beverage to be poured or drunk from the opening.

25 Claims, 7 Drawing Sheets

HYBRID BEVERAGE CONTAINER

BACKGROUND OF THE INVENTION

Field of the Invention

The present invention relates to beverage containers, and more in particular to a specially constructed dispenser which allows a large volume of beverage to be filled in the container at a beverage fountain dispenser, sealed and then used for transport and drinking purposes.

Beverage containers used with fountain dispensers have been previously provided in a wide range of sizes and shapes. Fountain beverage dispensers are often used in fast food restaurants where either the counter person or the consumer will fill the container with a beverage so that it can be carried away for consumption either in a car or at a remote location. Since it is not possible, once the consumer has left the restaurant, to refill the beverage container, it is often desirable for the consumer to be provided with a container whose volume is substantially larger than typical 8 or 12 ounce cups. Despite its size, the container must be easily handled and transportable, but it must also be substantially liquid-tight because of the movement of the container in transport. In addition, it must be easily filled at the fountain and then quickly and easily sealed in a liquid-tight relationship by the consumer without the use of special sealing equipment. Of course, such containers must also be relatively inexpensive since they are typically disposable.

Heretofore, beverage containers used with fountain dispensers have been formed of waxed paper or plastic material with a compatible snap-on lid. The snap-on lid typically provided a secure connection, but not a liquid-tight seal. In addition, the conventional snapon cover does not add attractiveness or volume to the container and is difficult to drink from.

Some examples of previously proposed fountain containers which use snap-on tops are shown, for example, in U.S. Pat. Nos. Des. 383,038; 5,427,269; 5,433,337; and 4,508,235.

It is an object of the present invention to provide a beverage container which is easily filled at a beverage fountain by a consumer and which can be closed and reclosed with a liquid-tight seal.

Another object of the present invention is to provide a beverage container which is relatively simple in construction, provides a liquid-tight seal between a beverage cup and a cover, and is economical to manufacture.

Another object of the present invention is to provide an improved beverage cup which may hold a large volume of liquid in a liquid-tight relationship and which is convenient to use to drink from.

SUMMARY OF THE INVENTION

In accordance with an aspect of the present invention, a beverage container is provided which includes a cup and a generally dome shaped cover for the cup. Both the cover and the cup are formed so that they are stackable with other cups and covers for convenient storage next to a fountain dispenser. The cover includes an open neck projecting upwardly from it and a cap which is rotatably mounted on the neck for selectively opening and closing the neck to allow a beverage to be dispensed from the cup. The cup and cover have cooperating threads for selectively securing the cover to the cup in a substantially liquid-tight relationship. The threaded arrangement includes cooperating tapered surfaces on the cup and the cover to form a seal, with stop means on the cup engaging the cover as it is threaded into position to limit threading of the cup and thereby properly position the tapered seal surfaces with respect to each other.

The above, and other objects, features and advantages of this invention will be apparent in the following detailed description of an illustrative embodiment thereof, which is to be read in connection with the accompanying drawings, wherein:

DETAILED DESCRIPTION

Figure 1:
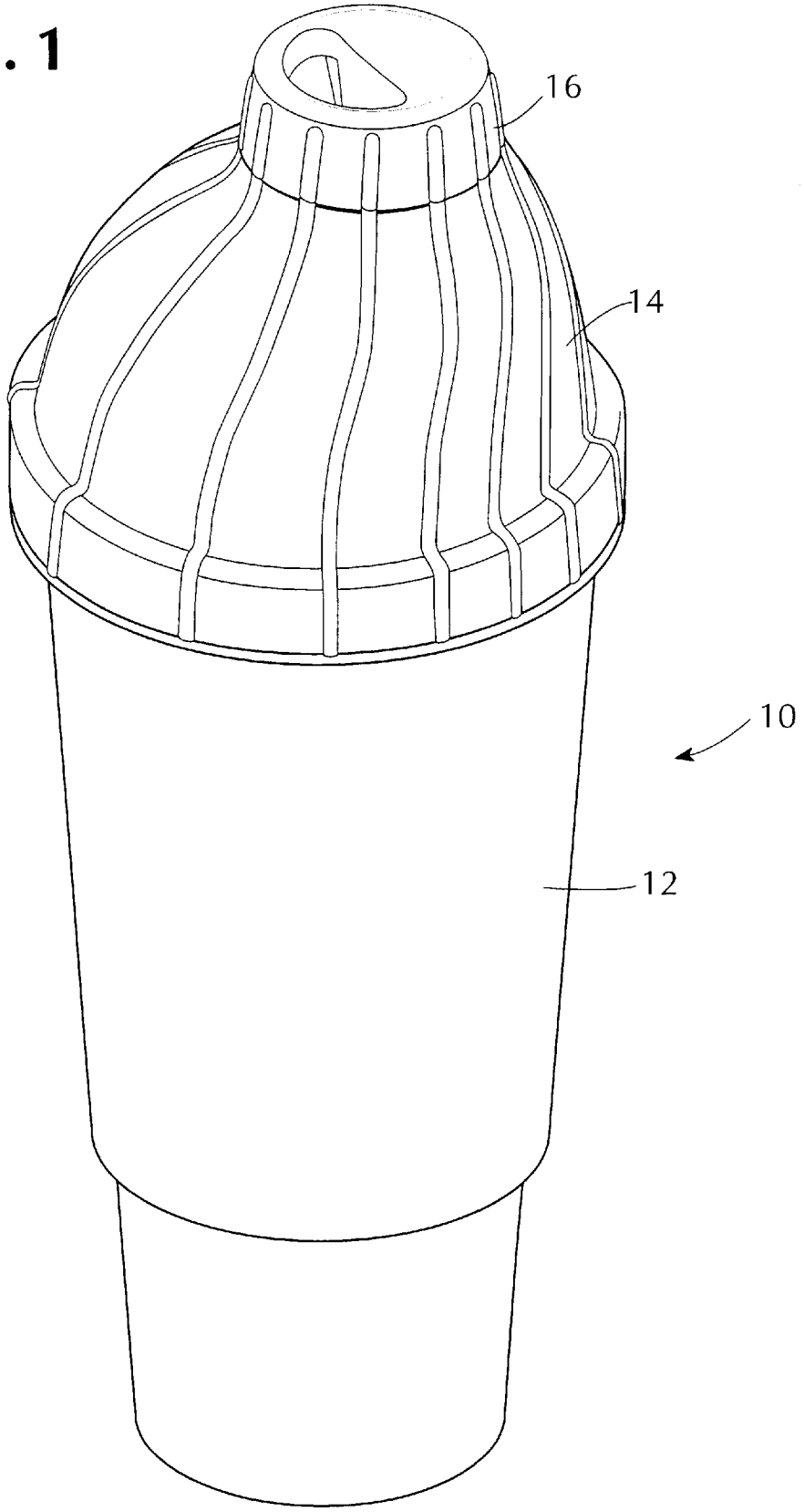
FIG. 1 is a perspective view of a beverage dispensing cup constructed in accordance with the present invention.
Figure 2:
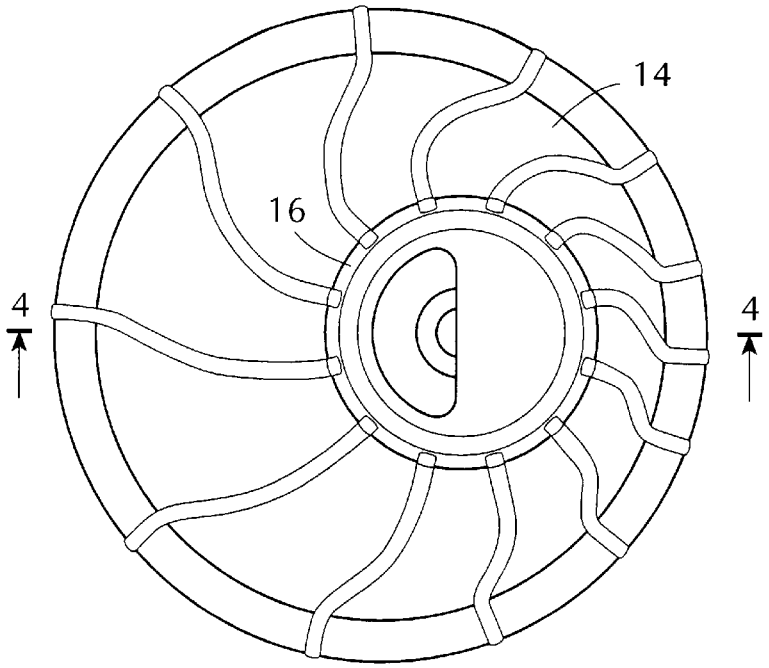
FIG. 2 is a top plan view of the cup with its cap in the closed position.

Referring now to the drawings in detail, and initially to FIG. 1, a beverage container 10, constructed in accordance with the present invention, is illustrated. The container includes a cup member 12, a dome-shaped cover 14, and a cap 16 for cover 14. These elements are shown more clearly in FIG. 6, wherein it is seen that cup 12 includes an open upper end 20, a peripheral side wall 22, and a base 24. The peripheral side wall 22 includes a first upper section 25 and a lower section 26. Both of these side wall sections are slightly tapered from the top of the cup towards the bottom. However, the lower end of side wall section 25 has a larger diameter than the upper end of the side wall section 26. These two side wall sections are connected by an integral step portion 28, as is known in the art. Of course, the cup shape may take any desirable shape without materially affecting the operation of the cup, however the particular shape shown is believed to function best to hold a large volume of liquid (32 ounces) in a conventional car cupholder. Thus, the particular shape illustrated is provided so that lower side wall portion 26 has a diameter which will fit in a conventional beverage cupholder provided in most automobiles today. Side wall portion 26 is dimensioned to perform the function of fitting in these cupholders to maintain the cup in place, while the side wall portion 22 is not constrained by the cupholder and provides the function of producing increased volume for the cup. The height of the cup is selected to conveniently fit beneath a conventional fountain dispenser for filling.

Figure 4:
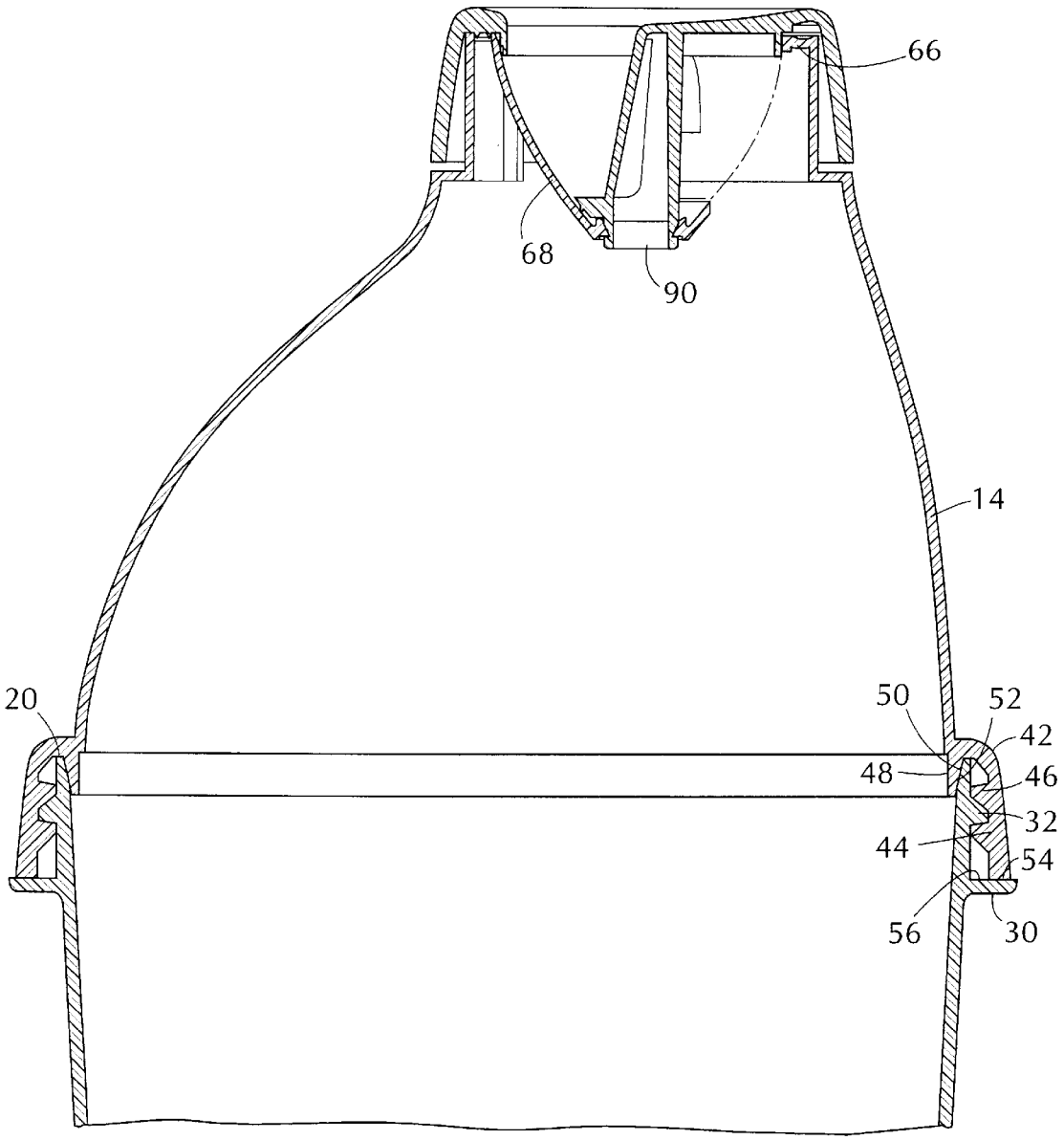
FIG. 4 is a sectional view taken along line 4—4 of FIG. 2.

The upper end 20 of cup 12 includes an annular peripheral flange 30 which extends laterally away from the cup, as seen, for example, in FIG. 4. In addition, a thread form 32 is provided on the outer surface of the cup between upper edge 34 and flange 30. The thread form may be shaped in any desired manner, although the preferred form is a double thread form for quicker and more secure engagement.

Figure 5:
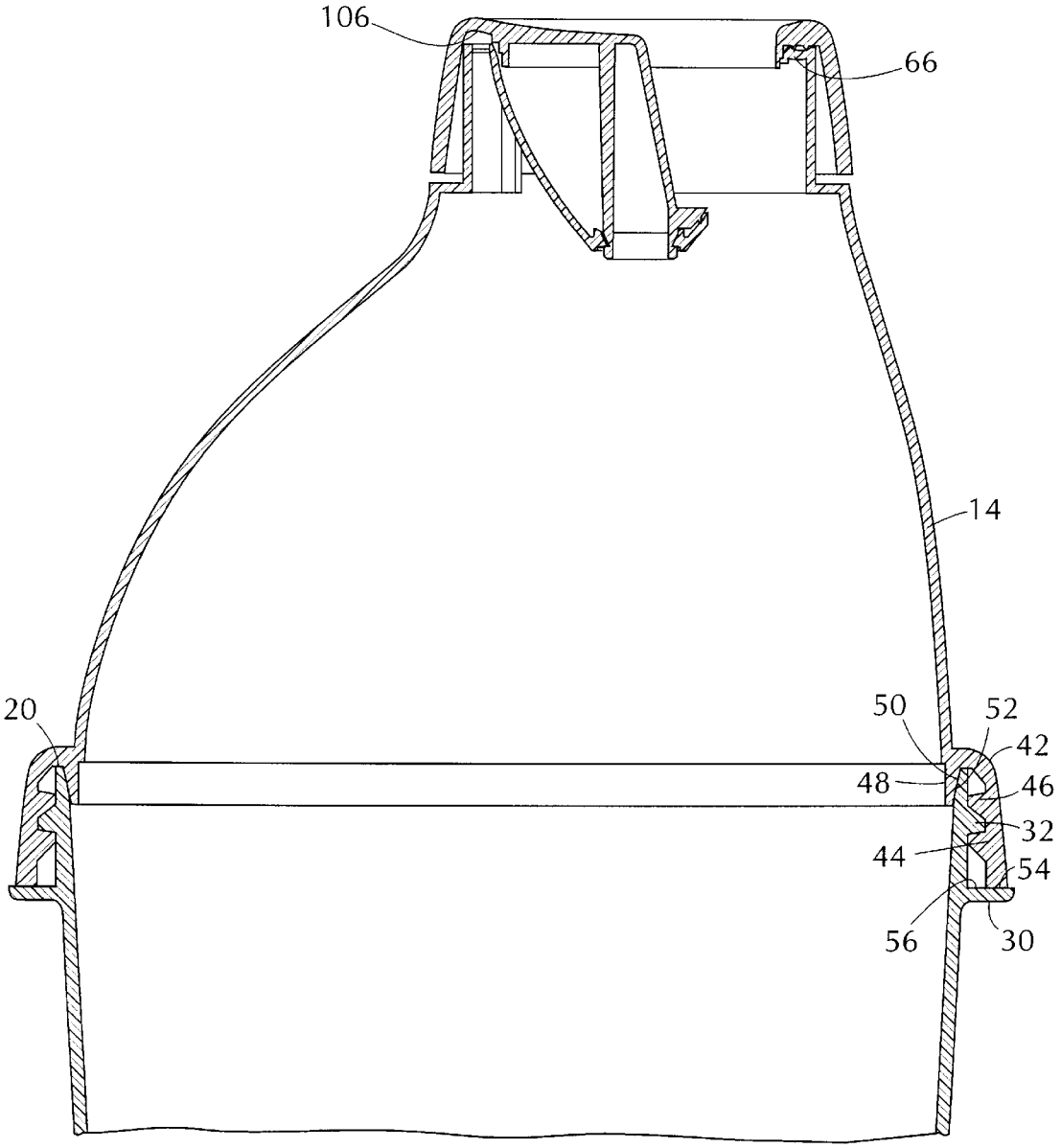
FIG. 5 is a sectional view taken along line 5—5 of FIG. 3.

Cover 14 is generally dome-shaped and includes an upper beverage dispensing neck 40 and a lower end 42. The lower end 42 of cover 14 is seen in cross-section in FIGS. 4 and 5. It includes an annular wall 44 integral with cover 14 and has an internal threaded form 46 that is adapted to cooperate with thread 32 to allow the cover to be threadedly engaged with the cup. In addition, lower end 42 of cover 14 includes a downwardly extending annular flange 48, which is interiorly spaced from threads 46. This flange has an outer surface 50 which is slightly tapered inwardly and downwardly. It is located to cooperate with the tapered inner surface 52 of the upper edge 20 of the cup. Tapered surface 52 is complementary to surface 50 so that these surfaces engage each other as shown in FIGS. 4 and 5 to form a liquid-tight seal when the cover is threaded onto the cup. In addition, wall 44 is dimensioned such that its lower end 54 will engage the upper surface 56 of flange 30 when the surfaces 50, 52 properly engage each other. This assures that the cap is not over tightened on the cup while still providing a liquid-tight seal.

In the illustrative embodiment of the invention, cover 14 has a plurality of decorative ribs 60 formed thereon to provide additional ornamentation to the container for the consumer. The particular shapes of the ribs form no part of this invention.

Figure 7:
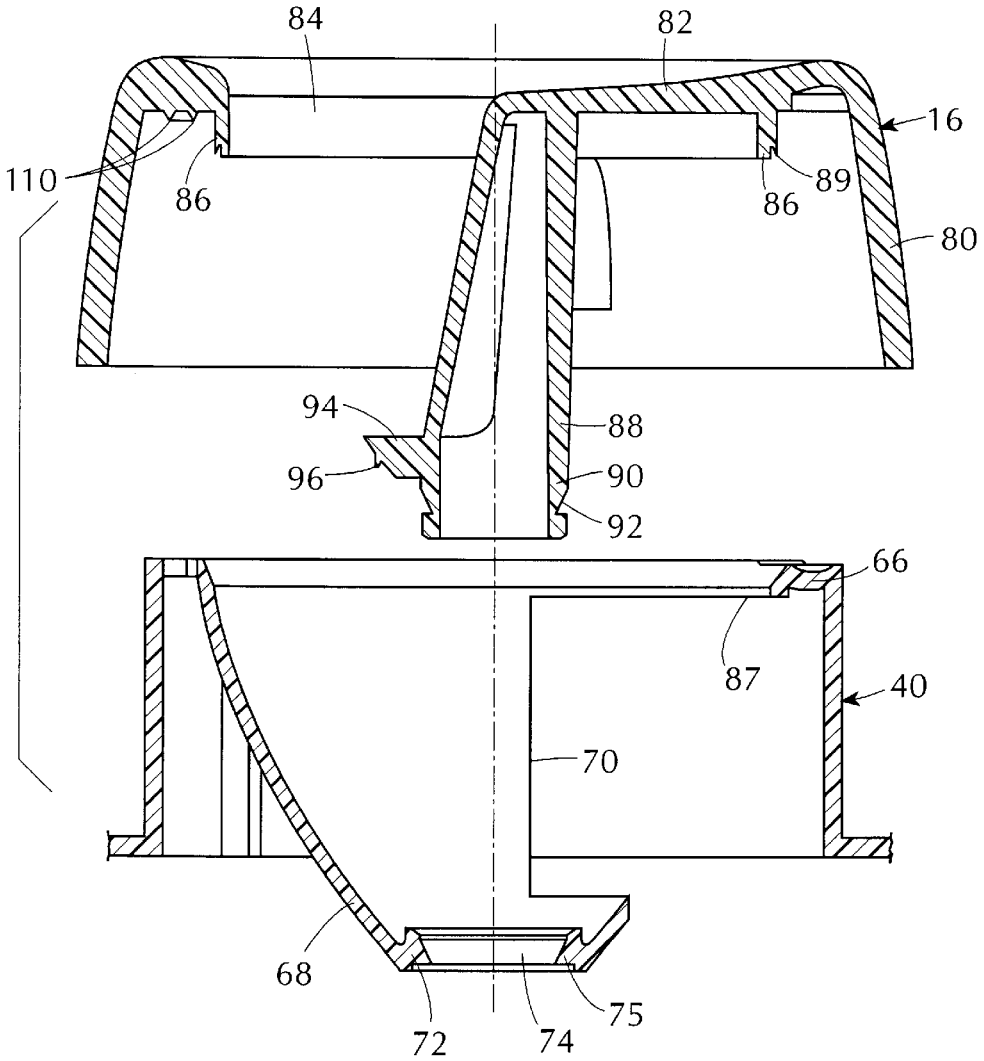
FIG. 7 is an enlarged exploded perspective view of the neck portion of the dome and the cap which selectively opens and closes the neck.

The neck 40 of cover 14 is integral with cover 14 and includes a generally cylindrical upwardly projecting wall 62 surrounded by a generally flat shoulder 64. Wall 62 extends upwardly for a predetermined dimension to a flat surface 66 which projects inwardly from the wall, as seen in FIG. 4. A generally frustro-conical curved wall member 68 extends downwardly from the wall 66, as seen most clearly in FIG. 7. This wall extends through an arc of somewhat more than 180 degrees and is cut, as seen in FIG. 7, to form an opening 70 therein in the balance of its arc. Opening 70 in wall 68 allows beverage to be dispensed from the cup through cover 14 and the opening 70 for consumption. The generally inverted frustro-conical wall 68 also has a base member 72 which is relatively flat. This base member has an opening 74 formed therein for purposes to be described momentarily.

Figure 6:
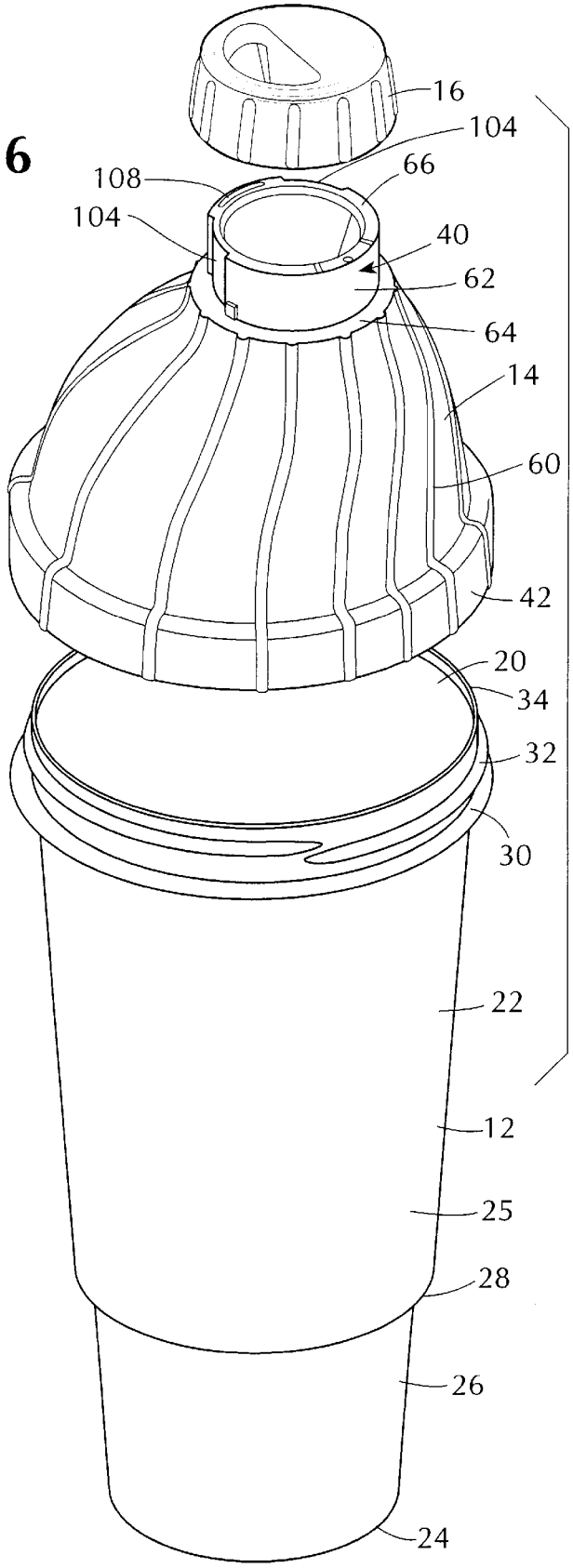
FIG. 6 is an exploded perspective view of the cup, dome and cap.

Cap 16 is rotatably mounted on neck 40 to selectively open and close opening 70 in wall 68. As seen most clearly in FIGS. 4, 7 and 8, cap 16 is a generally inverted cup-shaped member having a peripheral wall 80 and an integral upper wall 82. Upper wall 82 has an opening 84 formed therein, which is generally semi-circular, as seen in FIG. 6, and is defined in part by a depending flange 86 formed in the cap. This flange is shaped to mate with the surface 87 of the wall 66 about opening 70 in neck 40, as seen in FIG. 7. It has a notched flexible edge 89 (FIG. 7) to form a seal with wall 87. In addition, cap 16 includes an integral post 88 which extends downwardly from the upper surface 82. This post is adapted to snap fit in opening 74 of the base 72 of wall 68 while allowing the cap to rotate in the base and simultaneously form a liquid-tight seal.

As seen in FIGS. 4 and 7, lower end 90 of post 88 includes an annular notch 92 formed therein. This notch is generally complementary to the internally extending annular rib 75 formed in base 72 about opening 74. During assembly, cap 16 is simply press fit down into the neck of the bottle until the end 90 of the post enters opening 74 so that notch 92 is engaged by rib 75. Because the bottle and cap are formed of slightly flexible plastic material such as thin walled polypropylene or the like, the cap will flex to accept the post and hold it in place while allowing rotation. This arrangement also provides a substantially liquid-tight seal between the cap and the post.

Figure 8:
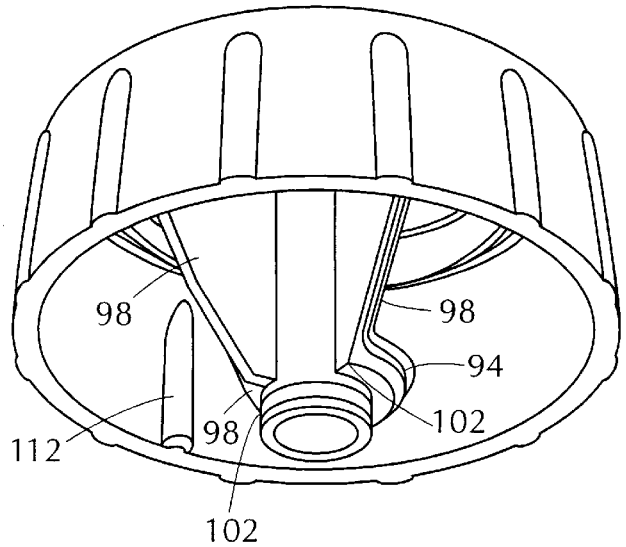
FIG. 8 is a bottom perspective view of the cap.

In addition, cap 16 includes a partially circular flange 94 extending therefrom through an arc which is approximately equal to the arc of the wall 68. This flange includes a wiper seal 96 (like edge 89 as previously discussed), as seen in FIG. 7, which engages the wall 68 (as seen in FIG. 4) to aid in providing a liquid-tight seal. Furthermore, the post 88 has three web seals 98 extending therefrom, as shown in FIG. 8. These seals extend from the ends 102 of the flange 94 and from the open arc of the flange 94 between the other two ribs, as seen in FIG. 8. That central rib is shown in phantom lines in FIG. 4 for clarity.

Figure 3:
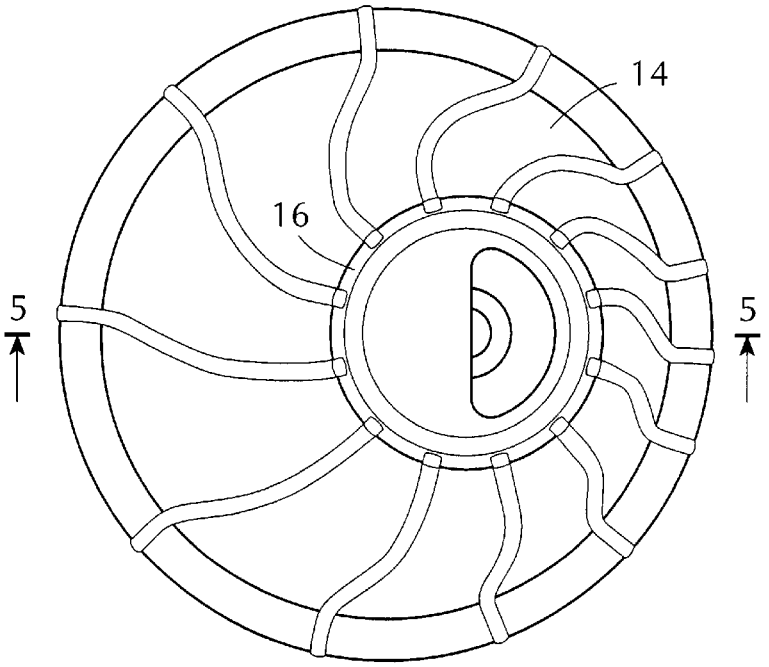
FIG. 3 is a top plan view similar to FIG. 2 with the cap in its open position.

In the closed position of the cap, as seen in FIG. 4, the two diametrically opposed ribs 98 (which cannot be seen in FIG. 4) engage the complementary inner surface of the wall 68 and form a seal therewith to prevent liquid from flowing out of opening 70. When the cap is rotated through 180 degrees, into the position shown in FIG. 5, the opening 84 of the cap is moved directly above the opening 70 in wall 68, so that beverage can be dispensed from the container. It is noted that in the preferred embodiment of the invention, neck 40 is located in an asymmetric position on the dome, so that when the cover is moved to its opened position, the opening is preferentially located towards the side of the cover and cup, as seen in FIG. 3, to allow for easy drinking of the beverage directly from the cap. Alternatively, a straw or the like can be placed in the cap in its open position or the beverage can simply be poured from the cap if desired.

In order for a user to be able to readily sip beverage from the cup an air entry passageway is provided. As best seen in FIG. 6 neck 40 includes two slot like indentations 104. With cap 16 in position on neck 40 the indentations 104 allow air passage from the exterior into the space provided by indentations 104. To permit air which enters through indentations 104 to flow into the beverage container the interior peripheral surface 106 (See FIG. 5) is designed to be spaced from the flat surface 66 at the top of the cylindrical wall 62 on the neck of cover 14. In addition, between indentations 104 there is provided an arcuately shaped slot 108 to permit air which enters through indentations 104 to flow into the interior of cup 10. The indentations 104 and slot 108 are positioned so that when cap 16 is rotated to the drink position the indentations 104 and slot 108 permit this air flow.

When the cap 16 is rotated to the closed position it is desirable to seal off slot 108 to prevent air flow into the cup and beverage leakage out of the cup. Accordingly, cap 16 is provided with an arcuately shaped projection 110 which is shaped to correspond to and fit into slot 108. Projection 110 is positioned on cap 16 to be in register with slot 108 when the cap is rotated to its closed position as represented in FIG. 4.

In order to provide a tactile feel to the user in positioning the cap from the closed position shown in FIG. 4 to the open position shown in FIG. 5, the interior surface of the wall 80 of cap 16 is provided with a vertically extending projecting rib 112 positioned so it coincides with one of the slots 104 when the cap is in the closed position and the other slot 104 when the cap is in the open position. Thus, rotation of the cap will give a tactile feel when the cap is in either of the two positions and rib 112 registers with slot 104.

Figure 9:
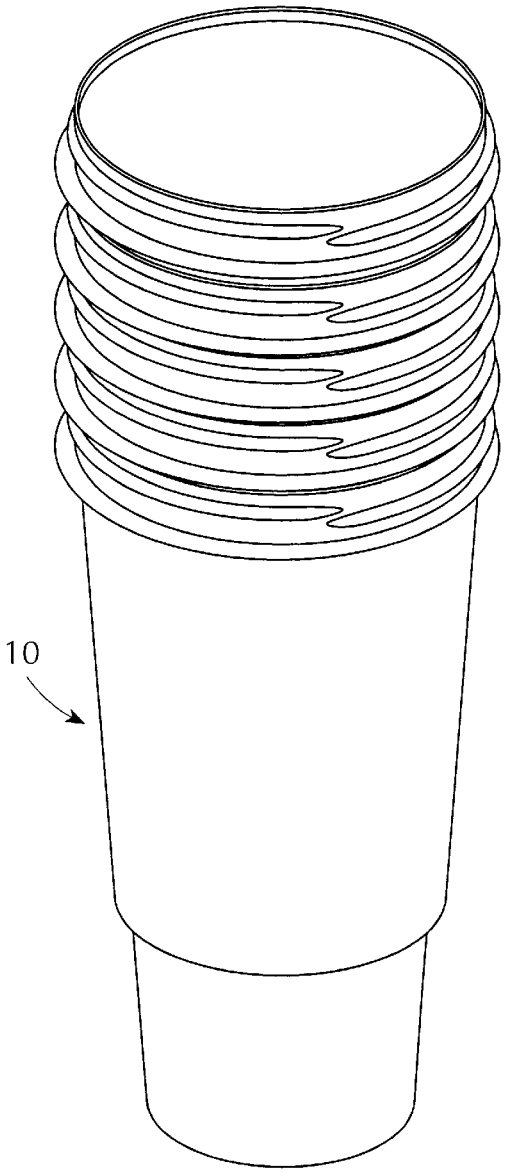
FIG. 9 is a perspective view of a plurality of the cups of the beverage container stacked with one another.
Figure 10:
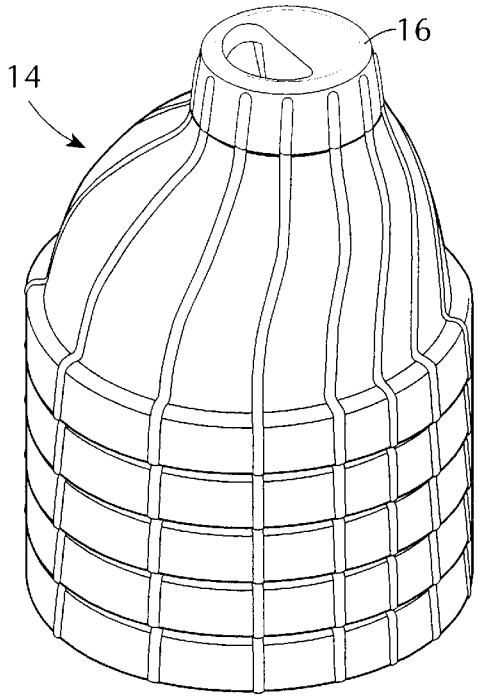
FIG. 10 is a perspective view of a plurality of the covers for the beverage container stacked with one another.

While the neck of cap 16 is asymmetrical on the cover, the cover is generally symmetrical and is stackable. Likewise, cup 12 is stackable. That is, these elements can be stacked (see FIGS. 9 and 10) with other like elements next to a beverage fountain dispenser, for individual selection by the consumer and/or assembly by the consumer.

In accordance with the invention as described above, a very reliable beverage container is provided for use with a fountain dispenser. The container can be made of light-weight plastic material so that it is disposable if desired, but it will contain a large volume of beverage in a liquid-tight seal. The construction is such that the cover and cup are easily manipulable by the consumer to fill the cup and seal it with the attractive asymmetric dome that allows easy dispensing without leakage by the consumer.

Although an illustrative embodiment of the present invention has been described herein with reference to the accompanying drawings, it is to be understood that the invention is not limited to that precise embodiment, and that various changes and modifications may be effected therein by those skilled in the art without departing from the scope and spirit of this invention.

I claim:

1. A beverage container comprising a stackable cup, a stackable cover for the cup, cooperating means on the cover and cup for selectively securing the cover to the cup in a substantially liquid-tight relationship; said cover having a beverage dispensing opening therein and cap means for selectively closing said opening to prevent a beverage in the container from being poured out of the opening;

said cup having an open upper end, a peripheral wall and an opposed base; said peripheral wall including a first tapered wall portion extending from the based toward said upper end, a second tapered wall portion extending from said upper end toward the base; and a step portion connecting said first and second wall portions;

said cover including a generally cylindrical neck having said opening formed therein and said cap being rotatably mounted on said neck; and said neck including an inverted generally frustro-conical wall within the neck, said wall defining an open upper end and an inner smaller diameter base, said opening being formed in said wall; said cap having a central pivot pin pivotally mounted in said inner smaller diameter base, seal means extending from said pin for engaging said generally frustro-conical wall and positioned to block said opening in the frustro-conical wall in a first position of the cap and allow passage of a beverage from the cup through said opening in a second position thereof.

2. A beverage container as defined in claim 1 wherein said pivot pin and said inner smaller diameter base of the generally frustro-conical wall include cooperating snap-fit means for holding the cover on the neck of the bottle for relative rotation.

3. A beverage container as defined in claim 2 wherein said post and inner smaller diameter base have complementary conical surfaces for forming a generally liquid-tight seal therebetween.

4. A beverage container as defined in claim 1 wherein said neck has an upper end including a shoulder portion from which said generally frustro-conical wall depends, said shoulder including an access opening therein to permit air flow into said container when said cap is in said second position and cooperating means on said cap to block air flow into said container when said cap is in said first position.

5. A beverage container as defined in claim 4 wherein said neck includes an exterior slot positioned on said neck near said access opening to permit air flow from exterior said cap into said container when said cap is in said second position.

6. A beverage container as defined in claim 5 wherein said cap includes a pair of exterior slots and an interior projection such that said projection is in register within said slots when said cap is in its first and second positions to provide an indication of those positions.

7. A beverage container as defined in claim 1 wherein said neck includes means formed therein defining an air passage in addition to said opening formed in the neck for allowing air flow to the container while the beverage is dispensed therethrough.

8. A beverage container as defined in claim 7 wherein said cap includes seal means for sealing the air passage when the cap is in position closing said beverage dispensing opening in the neck.

9. A beverage container comprising a cup, a generally dome-shaped cover for said cup including an open neck projecting upwardly therefrom, and a cap rotatably mounted on said neck for selectively opening and closing the neck to allow a beverage to be dispensed from the cup, said cup and cover having cooperating structure for selectively securing the cover to the cup in a substantially liquid-tight relationship; said cooperating structure comprising cooperating thread forms on the cover and cup for selectively threadedly engaging the cover and cup;

said cup having an open upper end, including an upper edge having an outwardly tapering inner surface and said cover including a sealing flange having a tapered surface complementary to and positioned to engage the tapering inner surface of the cup when the cover is threadedly engaged with said cup; and said neck including an inverted generally frustro-conical wall within the neck, said wall defining an open upper end and an inner smaller diameter base, a beverage dispensing opening opening being formed in said wall; said cap having a central pivot pin pivotally mounted in said inner smaller diameter base, a sealing surface extending from said pin for engaging said generally frustro-conical wall and positioned to block said opening in the frustro-conical wall in a first position of the cap and allow passage of a beverage from the cup through said opening in a second portion thereof.

10. A beverage container as defined in claim 9 wherein said neck including means defining an air passage in addition to the beverage dispensing opening therein for allowing air flow to the container while the beverage in dispensed therethrough.

11. A beverage container as defined in claim 10 wherein said cap includes seal means for sealing the air passage when the cap is in position closing said beverage dispensing opening in the neck.

12. A beverage container comprising a cup, a generally dome-shaped cover for said cup including an open neck, and a cap rotatable mounted on said neck for selectively opening and closing the neck to allow a beverage to be dispensed from the cup, said cup and cover having cooperating interlocking structure to selectively secure the cover to the cup in a substantially liquid-tight relationship;

said neck including an inverted generally frustro-conical wall within the neck, said wall defining an open upper end and an inner smaller diameter base, said opening being formed in said wall; said cap having a central pivot pin pivotally mounted in said inner smaller diameter base, a sealing surface extending from said pin to engage said generally frustro-conical wall and positioned to block said opening in the frustro-conical wall in a first position of the cap and allow passage of a beverage from the cup through said opening in a second position thereof.

13. A beverage container as defined in claim 12 wherein said pivot pin and said inner smaller diameter base of the generally frustro-conical wall include cooperating snap-fit means for holding the cap on the neck of the bottle for relative rotation.

14. A beverage container as defined in claim 13 wherein said post and inner smaller diameter base have complementary conical surfaces for forming a generally liquid-tight seal therebetween.

15. A beverage container as defined in claim 12 wherein said neck has an upper end including a shoulder portion from which said generally frustro-conical wall depends, said shoulder including an access opening therein to permit air flow into said container when said cap is in said second position and cooperating means on said cap to block air flow into said container when said cap is in said first position.

16. A beverage container as defined in claim 15 wherein said neck includes an exterior slot positioned on said neck near said access opening to permit air flow from exterior said cap into said container when said cap is in said second position.

17. A beverage container as defined in claim 16 wherein said cap includes a pair of exterior slots and an interior projection such that said projection is in register within said slots when said cap is in its first and second positions to provide an indication of those positions.

18. A beverage container comprising a cup, a generally dome-shaped cover for said cup including an open neck projecting upwardly therefrom, and a cap rotatable mounted on said neck for selectively opening and closing the neck to allow a beverage to be dispensed from the cup, said cup and cover having cooperating structure for selectively securing the cover to the cup in a substantially liquid-tight relationship; said cooperating structure comprising cooperating thread forms on the cover and cup for selectively threadedly engaging the cover and cup;

said cup having an open upper end, including an upper edge having an outwardly tapering inner surface and said cover including a sealing flange having a tapered surface complementary to and positioned to engage the tapering inner surface of the cup when the cover is threadedly engaged with said cup; and a stop member on the cup for engaging said cover to limit the extent to which the cover may be threaded down on the cup and insure proper sealing engagement between said sealing surfaces;

said neck including an inverted generally frustro-conical wall within the neck, said wall defining an open upper end and an inner smaller diameter based, said opening being formed in said wall; said cap having a central pivot pin pivotally mounted in said inner smaller diameter base, a sealing surface extending from said pin for engaging said generally frustro-conical wall and positioned to block said opening in the frustro-conical wall in a first position of the cap and allow passage of a beverage from the cup through said opening in a second portion thereof.

19. A beverage container as defined in claim 18 wherein said pivot pin and said inner smaller diameter base of the generally frustro-conical wall provide a cooperating snap-fit to hold the cap on the neck of the bottle for relative rotation.

20. A beverage container as defined in claim 19 wherein said post and inner smaller diameter base have complementary conical surfaces for forming a generally liquid-tight seal therebetween.

21. A beverage container as defined in claim 20 wherein said neck has an upper end including a shoulder portion from which said generally frustro-conical wall depends, said shoulder including an access opening therein to permit air flow into said container when said cap is in said second position and cooperating means on said cap to block air flow into said container when said cap is in said first position.

22. A beverage container as defined in claim 21 wherein said neck includes an exterior slot positioned on said neck near said access opening to permit air flow from exterior said cap into said container when said cap is in said second position.

23. A beverage container as defined in claim 22 wherein said cap includes a pair of exterior slots and an interior projection such that said projection is in register within said slots when said cap is in its first and second positions to provide an indication of those positions.

24. A beverage container as defined in claim 20 wherein said cup has a peripheral wall and an opposed base; said peripheral wall including a first tapered wall portion extending from the base toward said open upper end, a second tapered wall portion extending from said upper end toward the base; and a step portion connecting said first and second wall portions.

25. A beverage container as defined in claim 24 wherein the smallest diameter of said second wall portion is adjacent said step portion and is larger than the largest diameter of said first wall portion.

* * * * *